United States Patent [19]

Ritchie et al.

[11] 4,245,876

[45] Jan. 20, 1981

[54] LAMINATED CONNECTOR

[75] Inventors: Leon T. Ritchie; Robert G. Harwood, both of Mechanicsburg, Pa.

[73] Assignee: AMP Incorporated, Harrisburg, Pa.

[21] Appl. No.: 655,803

[22] Filed: Feb. 6, 1976

Related U.S. Application Data

[63] Continuation-in-part of Ser. No. 504,579, Sep. 9, 1974, abandoned, which is a continuation-in-part of Ser. No. 432,121, Jan. 9, 1974, abandoned.

[51] Int. Cl.[2] ..... H01R 13/12

[52] U.S. Cl. ..... 339/59 M

[58] Field of Search ..... 339/17 LM, 17 M, 59 M; 29/629, 630 B

[56] References Cited

U.S. PATENT DOCUMENTS

| | | | |
|---|---|---|---|
| 2,701,346 | 2/1955 | Powell | 339/17 LM |
| 3,239,798 | 3/1966 | Silver | 29/629 |
| 3,340,440 | 9/1967 | Minter | 339/17 M |
| 3,399,452 | 9/1968 | Reid | 29/629 |

*Primary Examiner*—John McQuade

*Attorney, Agent, or Firm*—Russell J. Egan

[57] ABSTRACT

A connector is disclosed which is made from a plurality of electrical contacts, each of which is a resilient spring, spaced along a continuous web of insulative material which serves to locate the contacts in desired positions and provides an insulation back or cover for the contacts. The method and apparatus for making the subject laminated connector is also disclosed. The plurality of contacts are first formed from a continuous strip of metal, an insulative web is laminated to the metal contacts, and the laminated connector is bent by a continuous roller or die forming operation to desired curvilinear arcuate shapes. Discrete lengths of contacts formed together with the carrier strip are broken away or otherwise separated from the carrier strip either prior to or after the bending operation.

25 Claims, 24 Drawing Figures

LAMINATED CONNECTOR

CROSS REFERENCE TO RELATED APPLICATION

The present application is a continuation-in-part of our application Ser. No. 504,579 filed Sept. 9, 1974, now abandoned which in turn is a continuation-in-part of our application Ser. No. 432,121, filed Jan. 9, 1974, now abandoned.

BACKGROUND OF THE PRIOR ART

It has been the practice in the prior art to stamp and form electrical contacts or terminals from a continuous strip of metal. The contacts at first were individually assembled to a printed circuit board and then soldered fixedly in place. The disadvantage of such a technique involved a requirement for hand labor to sort the contacts from one another, to assemble the contacts in desired alignment within the board, and to straighten the contacts in their final desired positions after soldering the contacts in place. Because hand labor is costly, there has been considerable effort directed toward reducing the amount of hand labor required for assembly of contacts to a printed circuit board. One of the first improvements to result from such effort resided in locating the terminals serially along a common carrier strip which was formed integral with the terminals during the stamping and forming process. This permitted the carrier strip to be fed into an insertion machine which individually severed a terminal from the strip and forcibly inserted it into a printed circuit board. The prior art further evolved into a technique whereby a plurality of electrical terminals along a common carrier strip were located within a comb-type tool which aligned the plurality of terminals for simultaneous insertion within corresponding locations in a circuit board. Using this technique, insertion of a larger number of terminals could be accomplished. When a plurality of terminals were simultaneously inserted, the common carrier strip served to align the terminals while the terminals were soldered fixedly in place within the printed circuit board. Subsequently, the carrier strip was removed from the terminals, leaving the terminals individually located within the printed circuit board.

Another version of the above techniques is described in U.S. Pat. No. 3,618,207 wherein a plurality of terminals, which extend transversely from a common carrier strip, have a body of insulating material molded transversely across the contacts, in the form of a continuous strip, before the carrier strip is sheared from the contacts. However, the disclosed insulative material is rigid and would prevent or hinder further steps forming the terminals into particular configurations. The molding operation is also relatively slow and costly.

According to another technique in the prior art, for example U.S. Pat. No. 3,582,865, a plurality of terminals were formed by etching out selected areas of metal plating on at least one side of a polyimide substrate. Such terminals generally required an additional substrate in order to be sufficiently rigid to make the desired electrical interconnection between circuit components, such as printed circuits and the like. Another similar multiple contact connector is described in U.S. Pat. No. 3,401,369. According to this patent, a plurality of contact members are formed on a sheet of dielectric material by conventional printed circuit forming techniques. A conductive ground plane is bonded to the opposite side of the dielectric sheet and the whole assembly is formed into a substantially U-shaped configuration to receive a plurality of spaced connectors, such as on the edge of a printed circuit board. This connector has the disadvantage of requiring multiple bonding steps which add to the cost and production time.

U.S. Pat. No. 3,239,798 describes a multiple contact connector in which a plurality of spaced-apart, elongated, parallel contact strips are formed from a sheet of electrically conductive material, preferably by a known etching technique. The strip is placed between two sheets of insulation material and bonded thereto along only certain predetermined lengths of the contact strips. The ends of the strips are not bonded. The ends of the strips are formed into alternate arcuately extending resilient contacts and the laminar center portion is formed into a channel. The alteration of the arcuate ends causes the non-bonded insulation material to be separated from the formed contact ends to allow electrical contact with suitable circuitry. The steps of forming the connector according to this patent are quite complex.

SUMMARY OF THE INVENTION

The present invention relates to a method of forming a plurality of electrical contacts having an accurate, fixed, parallel spaced relationship. According to the invention, a standard means, such as a stamping press or roll blanking is utilized to stamp a plurality of contacts or terminals from sheet metal. The contacts or terminals are subsequently bonded in fixed parallel spaced relationship on a support web or substrate of insulation material. Instead of utilizing the stamping press to also form the contacts to desired shapes, the terminals are preferably serially conveyed between pairs of rollers which progressively form the contacts in successive stages to desired arcuate shapes. Such a roll forming technique is considerably faster than forming by a stamping press, since the rollers are merely rotated, whereas a stamping press requires a large number of opening and closing strokes to provide a forming operation. In addition, the roller surfaces have a greatly increased life as compared to the relatively short life of the stamping dies which are worn away by impact.

The invention further resides in laminating a continuous web of insulative material over a portion of each of a plurality of contacts prior to roll forming. This has the advantage that the contacts are precisely located and fixed with respect to one another by the web which further advantageously serves as an insulation covering or backing for the contacts. The contacts are preferably stamped from resilient spring material so the contacts are of sufficient thickness to be self-supporting and are yet resiliently flexible to provide contact pressure when engaged against a printed circuit board. The ends of the contacts project outwardly from the plastic sheet material to provide free-standing and self-supporting terminals. The plastic sheet material is sufficiently flexible to allow each of the contacts to flex individually with respect to itself without affecting its relationship to the adjacent contacts.

OBJECTS OF THE INVENTION

It is therefore an object of the present invention to produce a laminated connector having a plurality of electrical contacts fabricated from resilient spring material and formed into curvilinear or arcuate shapes, with the terminals being spaced and bonded to a resilient or a flexible web of material which forms an insulation cover or backing for the terminals.

Another object of the present invention is to produce a laminated electrical connector comprising a plurality of free-standing resilient spring contacts laminated to a continuous web of material which forms an insulation cover or back for the terminals, the ends of the terminals projecting outwardly from at least one side of the web to provide self-supporting electrical terminals.

Another object of the present invention is to teach a method and apparatus for fabricating a laminated connector whereby a plurality of electrical terminals are fabricated from resilient spring material, with the terminals being subsequently formed to desired curvilinear or arcuate shapes, and wherein the terminals are provided with a continuous web of insulation material bonded to at least portions of the terminals prior to forming the terminals to their desired arcuate shapes.

Other objects and many attendant advantages of the present invention will become apparent to those skilled in the art upon perusal of the following detailed description taken in conjunction with the accompanying drawings.

DETAILED DESCRIPTION OF THE INVENTION

Figure 1:
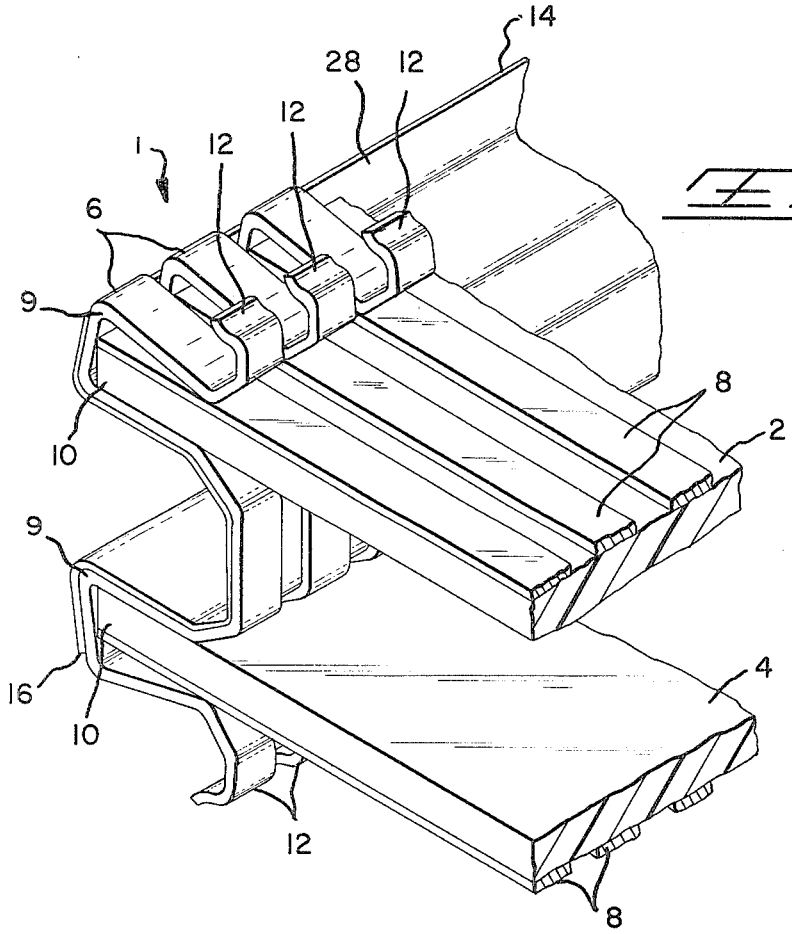
FIG. 1 is an enlarged fragmentary perspective of a laminated connector according to the present invention mounted to the edge margins of a pair of parallel, spaced, printed circuit boards.

FIG. 1 shows an exemplary laminated connector 1 which is connected to edge margins of a pair of parallel, spaced printed circuit boards 2 and 4. The connector 1 comprises a plurality of resilient spring terminals 6 serially spaced from one another and bonded to a backing or cover of plastic sheet material 28. The contact terminals 6 are of sufficient metal thickness to be free-standing and self-supporting. The inherent resilient spring properties of the terminals 6 permit the terminals to grip onto the printed circuit boards 2 and 4, with the terminals 6 respectively contacting the circuit pads 8 on the boards 2 and 4. As shown, the terminals 6 are fabricated from resilient spring material and are of sufficient thickness to remain in permanent curvilinear or arcuate configurations which enable them to be free-standing and self-supporting without the need for a housing or other bracing material to maintain the contacts in their desired configurations. In addition, the spring material properties of the terminals permit them to be bent into generally U-shapes 9 for gripping over edge margins 10 of the printed boards 2 and 4. The inherent spring properties also permit the terminals to apply pressure at the surfaces of contact with the circuit pads 8 of the boards 2 and 4 to ensure and establish good electrical connections. Also as shown, the backing of insulative sheet material 28 is applied only to a central portion of the terminals 6, with the free ends 12 of the terminals projecting outwardly of the edge margins 14 and 16 of the sheet material 28. The backing material 28 is sufficiently rigid to prevent relative flexure between adjacent contacts while allowing individual outward flexing of the free ends of contacts 6 to accommodate variations in thickness and surface warping of the boards 4 and 2. In addition, the contact ends 12 project outwardly from the sheet margins 14 and 16 further to insure that the contacts may flex independently of one another.

Figure 3:
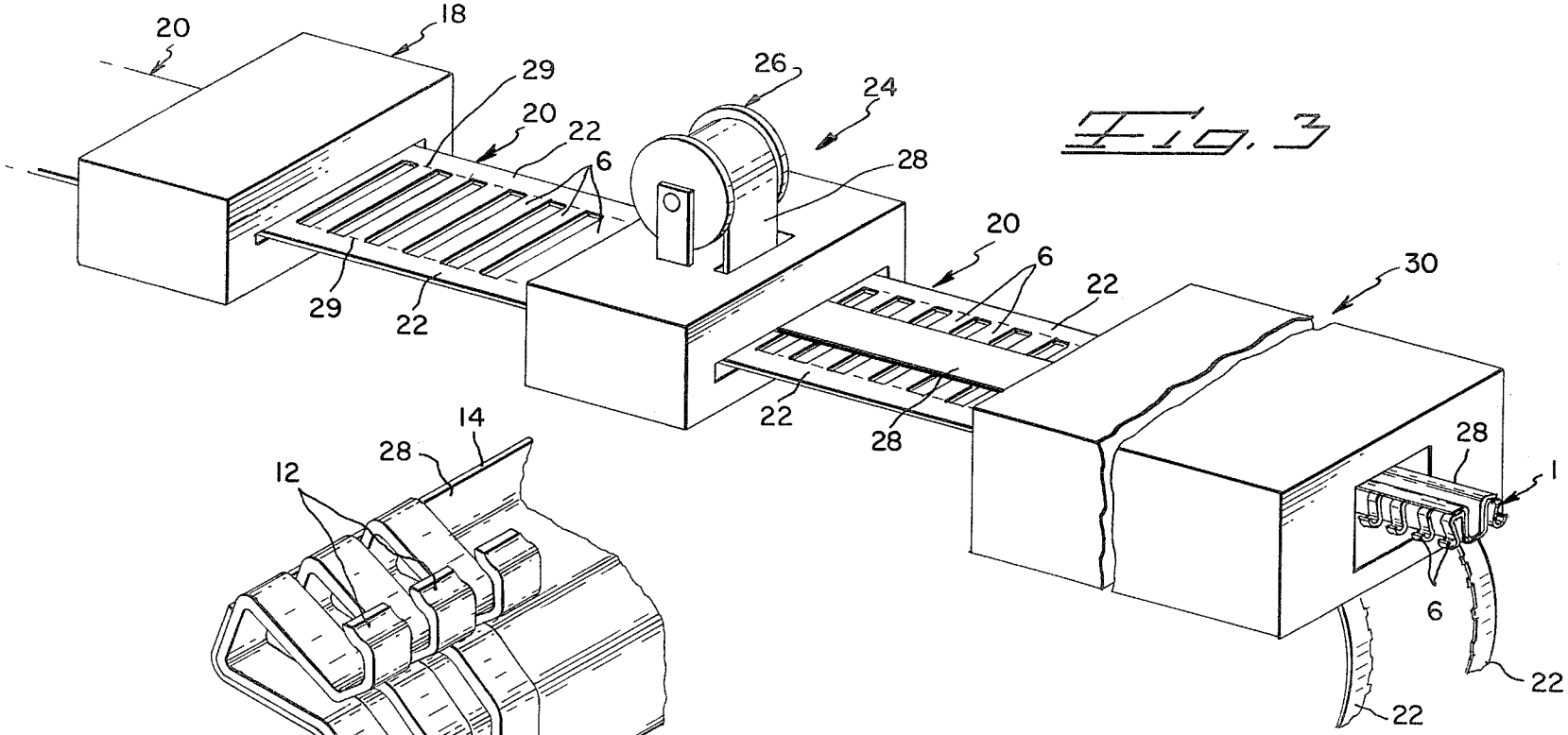
FIG. 3 is a schematic of an apparatus utilized to fabricate a laminated connector according to the present invention.

FIG. 3 of the drawings schematically illustrates an apparatus and operation for fabricating the laminated connector according to the present invention. The first stage 18 of the apparatus includes a standard stamping press or roll blanking press whereby a continuous strip of resilient spring metal 20 is fed between dies according to the practice well known in the prior art. It has been the practice in the prior art to provide the stamping press with a plurality of forming stages which would progressively impact on the contacts 6 to deform them to their desired final shapes. The design and fabrication of such forming stages requires highly skilled labor. In addition, the repeated impacting of the dies during the forming operation causes progressive die wear. The dies accordingly need to be repaired or replaced, especially in the case where the contacts to be formed are of small size, and consequently a few thousands of an inch in die wear would not be acceptable. According to the present invention, the forming stages in the stamping stage 18 are eliminated. Instead only the stamping stages of the press are utilized to provide the external outlines of the contacts 6. By elimination of the forming stages, die life is greatly increased. Instead, the present invention contemplates the forming operation to preferably take place in a roll forming operation.

To prepare the contacts 6 as they emerge from the stamping stage 18 for the roll forming stage, the contacts are conveyed through a laminating stage 24. A reel 26 containing a continuous web 28 of insulative material, such as Mylar, paper and other known materials, is placed in overlying relationship with respect to designated portions of the contacts 6, here shown as the center of the contacts. The web of material 28 is then laminated by bonding to the portions of the contacts 6 by the application of a suitable adhesive. Thus emerging from the laminating stage 24 are the contacts 6 attached to carrier strips 22, together with the insulative sheet material 28 laminated to portions of the contacts. A suitable insulation material was found to be Mylar, and a suitable binding agent for laminating the Mylar to the contacts 6 was found to be E. I. DuPont Nos. 49,000 or 49,002 adhesives. Also Kapton or Nomax plastic sheet material may be bonded with E. I. DuPont No. "WA" adhesive. The contacts 6 are maintained in alignment in this embodiment by virtue of their ends being integral with the carrier strips 22. Bonding the contacts 6 to the web 28 holds them in alignment during roll forming and afterwards. The central portions of the contacts 6 are maintained in alignment by the insulative sheet laminate 28. For example, the web is selected so as to be transversely flexible to enable deformation of the contacts to curvilinear shapes. Yet the web material is resistant to stretching and bending about its longitudinal axis, to maintain the central portions of the contacts 6 in deired alignment and in spaced relationship from one another.

The roll forming stage 30 is comprised of a series of roller pairs which progressively form the contacts 6 to curvilinear shapes, as will be explained with more particularity hereafter. The contacts may be severed from the carrier strips 22 either before or after bending of the contacts, for example in the roll forming stage 30 as illustrated in FIG. 3. Alternatively the carrier strips 22 may be left on the contacts 6 until after removal of the contacts 6 from the forming stage. As shown in FIG. 3, however, the strips 22 are removed substantially simultaneously with the start of roll forming. What emerges is shown generally at 1 as a continuous web of insulative material 28 laminated to a plurality of contacts 6 which are formed to curvilinear configurations. For example, the configurations of the contacts 6 may take the form as shown in FIG. 1.

The stamping stage may also be used to form a score 29 at the ends of the terminals 6 where they join the carrier strips 22. The contact ends are thereby weakened so that they are frangibly attached to the carrier strip permitting their separation from the carrier strip either before or after roll forming or after soldering in place within a printed circuit board.

Figure 5:
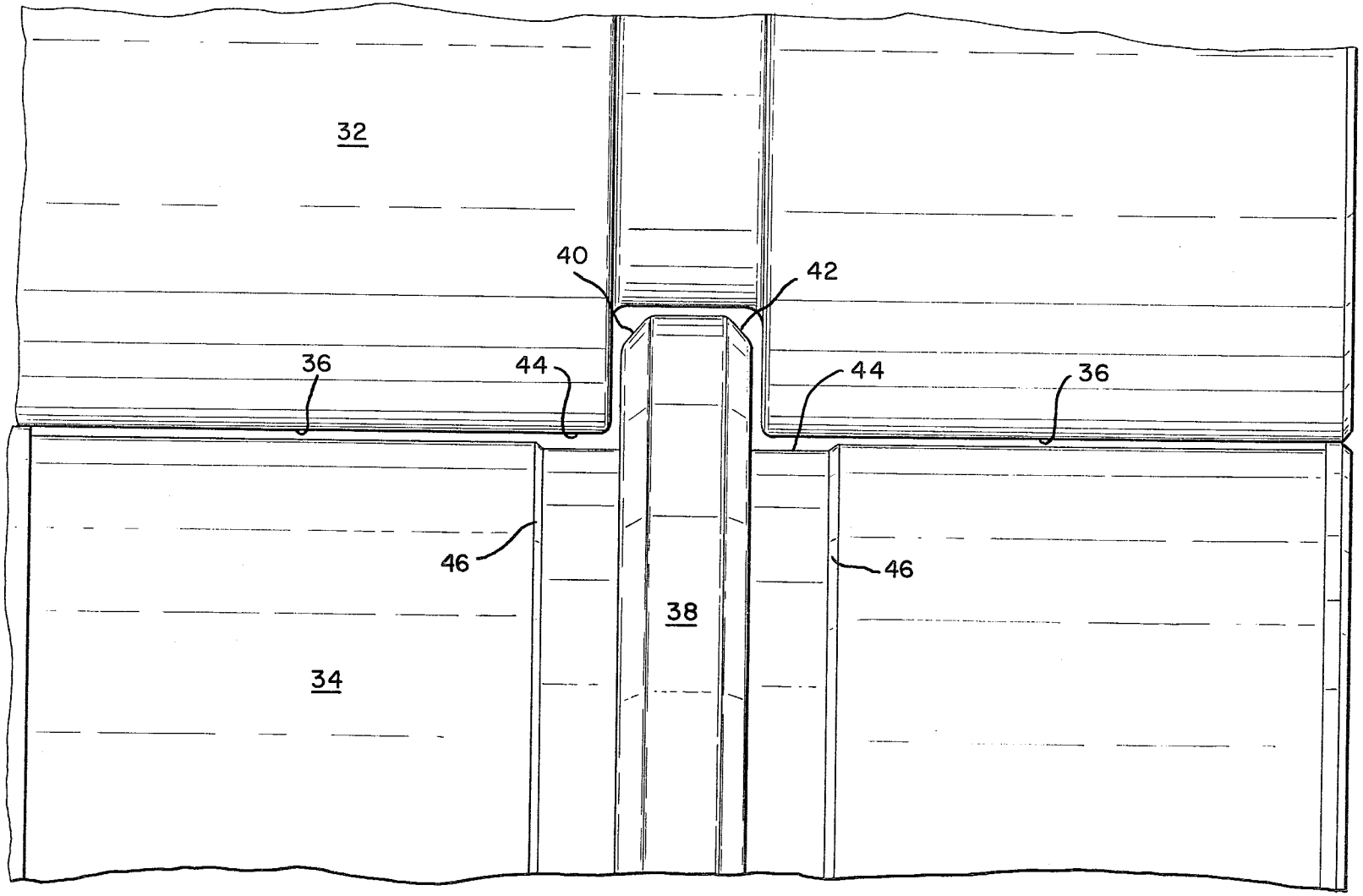
FIGS. 5, 6 and 7 are enlarged fragmentary elevations of corresponding pairs of forming rollers arranged in successive stages, which pairs of rollers are utilized to progressively form the contacts of the laminated connector into desired arcuate shapes.
Figure 6:
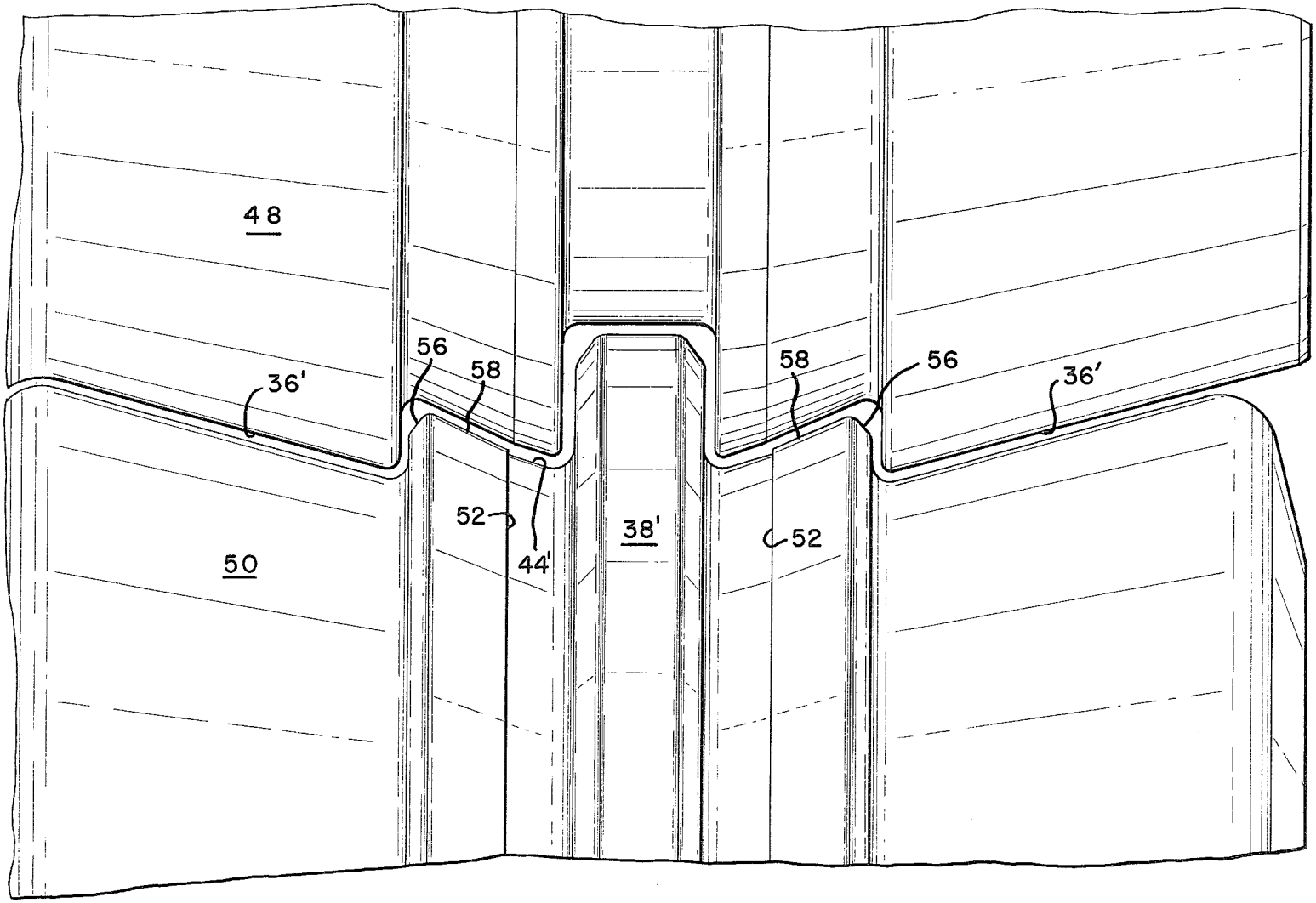
Figure 8:
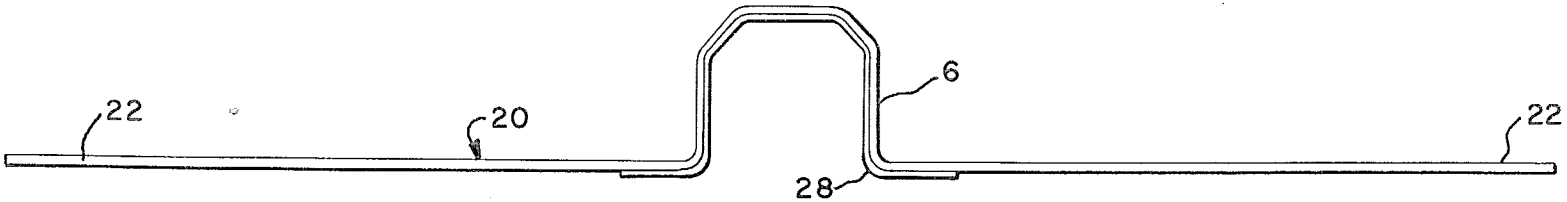
FIGS. 8, 9, and 10 are enlarged elevations illustrating the various stages of formation of the laminated connector conveyed between the successive stages of rollers illustrated in FIGS. 5–7.
Figure 9:
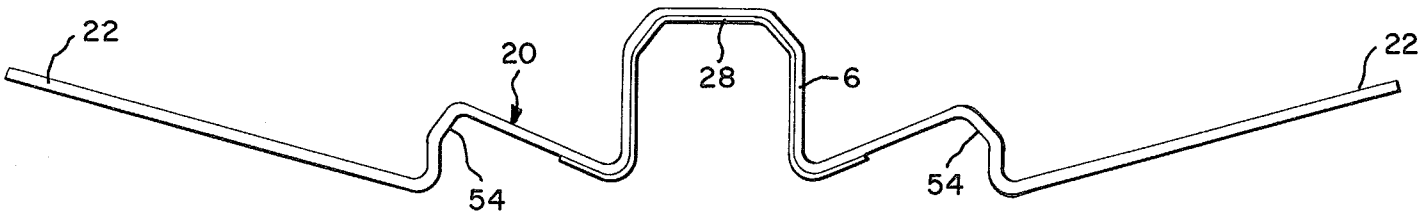
Figure 10:
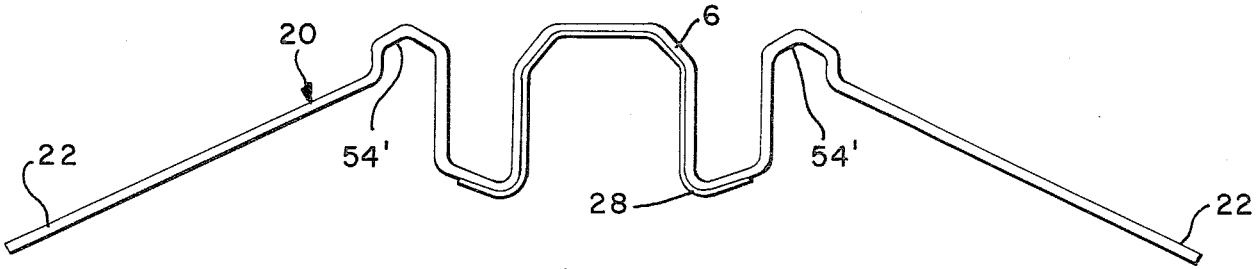

For a more complete description of the roll forming stage 30, reference will be made to FIGS. 5, 6, and 7, taken in conjunction with FIGS. 8, 9, and 10. FIG. 5 is an elevation illustrating the profiles of an exemplary pair of forming rollers 32 and 34. The rollers 32 and 34 are generally cylindrical and comprise a primary formation stage, which forms the contacts 6 into the exemplary primary configuration shown in FIG. 8. As shown in FIG. 5, the roll 34 is separated from the roll 32 by a clearance 36 to correspond with the thickness of the metal stock 20 from which the contacts 6 are stamped. The roll 34 is provided with a central enlarged section 38 chamfered on either side thereof at 40 and 42. Immediately adjacent to and in correspondence with the section 38, the clearance 36 is progressively widened at 44. This is accomplished by stepping or otherwise reducing the diameter of the roll 34 at 36 to provide a wider clearance. The wider clearance accommodates the extra thickness of the conveyed laminate assembly, such that the sheet material 28 is received in the widened clearance area 44. As the contacts 6 are fed into the clearances 36 and 44 the contacts 6 will be deformed over the section 38 to have a profile or curvilinear configuration corresponding to the surface of the section 38. From the primary forming stage, as shown in FIG. 5, the contacts 6 will be conveyed to an intermediate stage of forming rollers 48 and 50, illustrated in FIG. 6. There, the rollers 48 and 50 have generally frusto-conical surfaces defining a clearance 36' therebetween for receiving the thickness of the metal strip 20. The forming roll 50 is provided with a reduced stepped diameter 52 defining a clearance 44' between such reduced diameter and the diameter of the roll 48 overlying the roll 50. For example, the clearance 36' is substantially similar to the clearance 36, and the clearance 44' is substantially similar to the clearance 44, since the thicknesses of the stock material 20 and the sheet material 28 are desirably left substantially unchanged during the roll forming operation. The stock 20 will have the shape shown in FIG. 9 as it emerges from the forming stage provided by the rolls 50 and 48. As shown in FIG. 9 the contacts 6 are formed with curvilinear portions 54 which are the result of the roll 50 having a corresponding chamfer 56 immediately adjacent to corresponding frusto-conical portion 58 over which the contacts 6 are deformed.

Figure 7:
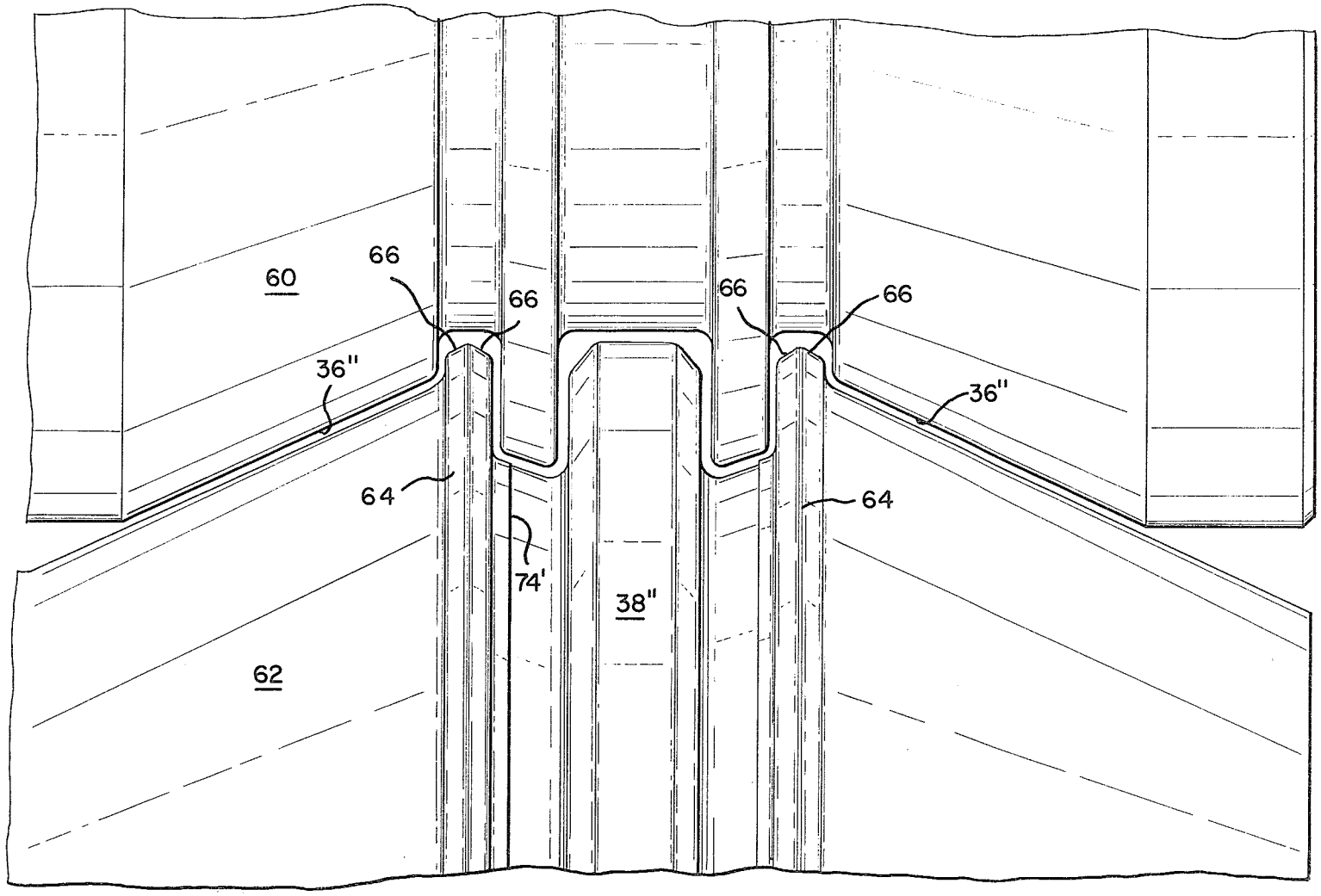

As shown in FIG. 7, a secondary forming stage is provided by a pair of cooperating rollers 60 and 62. The roller 62 has generally frusto-conical portions defining a clearance 36" with the cooperating roller surfaces 60. Again the central portion of the roller 62 is provided with an enlarged cylindrical portion 38" similar to the portion 38 of the roller 34. On each side of the section 38" are provided a pair of chamfered projecting sections 64 which are chamfered at 66. FIG. 10 illustrates the curvilinear shape of the contacts 6 and the stock 20 as it emerges from the forming provided by the rollers 60 and 62. More particularly, the contacts 6 are provided with a pair of curvilinear portions 54 which involve further deformations of the radiused portions 54 of the contacts as shown in FIG. 9. What is to be emphasized in the roll forming operation of the present invention is that the desired arcuate or curvilinear configurations of the contacts 6 must be obtained by gradual and progressive deformation of the metal stock 20 in successive stages to prevent breakage or jamming of the metal stock within the roll forming stages provided by the pairs of cooperating rollers. In actual practice, a larger number of stages of roller pairs are required than as shown in FIGS. 5, 6, and 7. Accordingly the illustrated rolling and forming stages are exemplary only. An advantage in using roll forming rather than stamping to produce equivalent configurations of the contacts 6 is that rolling friction results in slower rates of die wear than does impacting during a stamping operation. In addition, the cooperating roller surfaces are easier to tool than stamping dies. Of course, stamping dies may be tooled to provide more complex shapes, such as box enclosures, than can be made available by roll forming apparatus. For example, the surfaces of the forming rollers must either be perpendicular to or tapered outwardly from the axis of rotation of the rollers. Otherwise, the metal stock would not be able to be conveyed between the rollers but would be formed in gripping position over the surface of the rollers, preventing removal from the rollers for conveyance toward successive stages in the rolling operation.

Figure 2:
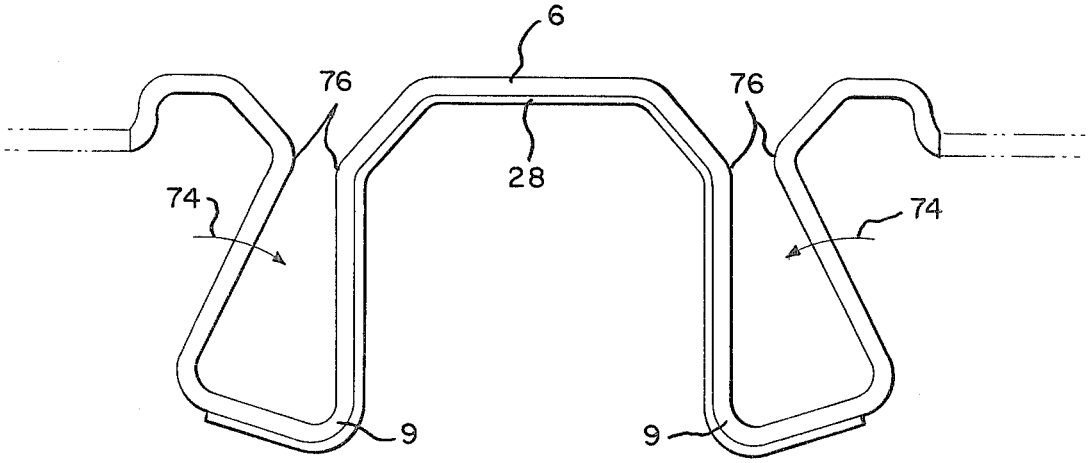
FIG. 2 is an enlarged side elevation of the laminated connector illustrated in FIG. 1.
Figure 4:
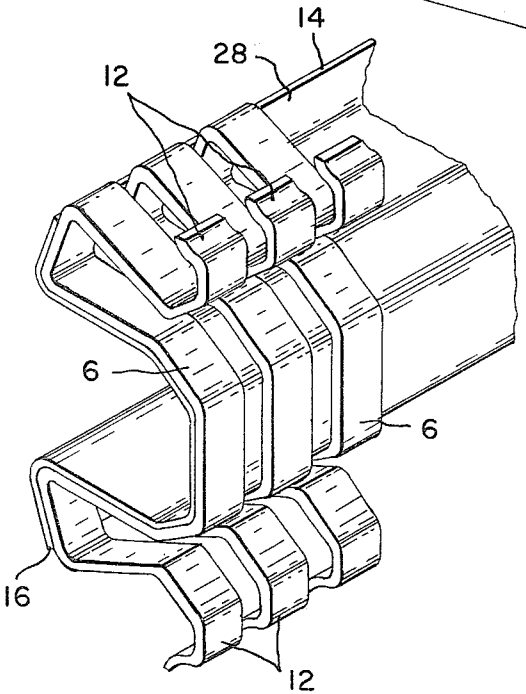
FIG. 4 is a fragmentary enlarged perspective of a laminated connector according to the present invention.
Figure 11:
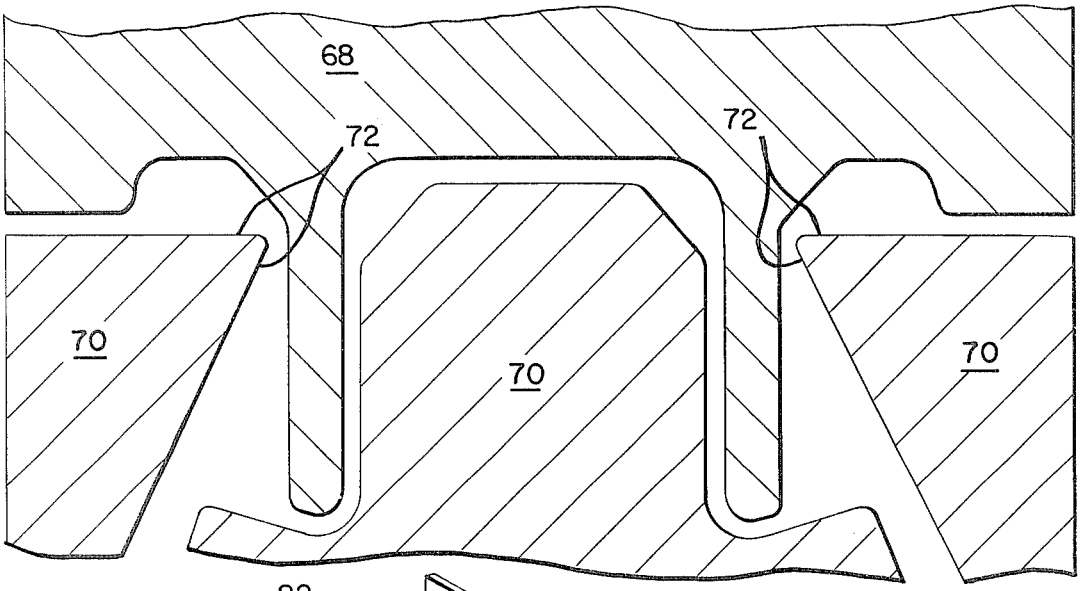
FIG. 11 is a fragmentary elevation of a further corresponding pair of forming rollers utilized to form the embodiment of the present invention.

It is however, often desired to provide inclinations in the curvilinear configurations of the contacts which would not ordinarily be available by ordinary roll forming operations. This can be accomplished by first forming the desirable curvilinear configurations by the successive stages of rollers, then utilizing a final stage where little forming is performed, but any loops or U-shaped areas of the curvilinear configurations may be further closed. There is shown more particularly with reference to FIGS. 11 and 12. In FIG. 11 a pair of final stage cooperating rollers 68 and 70 are illustrated. In this operation, the rollers 68 and 70 do not cooperate fully, since very little deformation is to be accomplished. Instead, the roller 70 is provided with an inclined forming surface 72 which serves, not primarily to provide smaller radii of curvature in the contacts 6, but to provide pivoting deformation forces in the direction of the arrows 74 shown in FIG. 2. Such deformation forces partially close the looped or U-shaped configurations in the contacts 6 for purpose to be explained. More particularly the partially closed looped portions thereby provide relatively narrow neck portions 76 opening into the loop portions of the curvilinear contact configurations. Therefore by utilizing a final pivoting stage in the roll forming stages 30, it is possible to provide closed loop portions in a contact configuration which would not ordinarily be possible by roll forming techniques prevalent in the prior art. It is of course to be emphasized that contacts of relatively miniature size can be provided with curvilinear configurations by roll forming. For example, an exemplary contact size contemplated to be formed by the present invention has the following dimensions:

The stock 20 is selected from #725 Copper Association designation copper having a thickness of 10 mils, the height of the curvilinear portions is 0.91 inches and a continuous web of insulative material 28 is of 5 mils thickness. To allow relative ease during the roll forming operation, the insulative material 28 has limited flexibility as described above. In addition, the flexible nature of the insulative material 28 permits each of the contacts 6 to operate independently as a resilient spring. This is shown more particularly in FIG. 4 wherein the insulative material 28 is shown laminated to only central portions of each of the contacts 6. The ends 12 of the contacts are permitted to project outwardly beyond the side margins 14 and 16 to provide cantilinear springs. The narrow neck openings 76 are selected to be of slightly less width than the thicknesses of the boards 2 and 4 such that when the boards are inserted through the narrow neck openings the contacts 6 will be resiliently deflected. As a result the inherent resiliency of the contacts 6 will provide pressure upon the contact ends 12 to insure a good electrical connection of the contact ends with the corresponding electrical pads 8 of the boards. The contact material can, if desired, be preplated, plated after forming, or spot plated to achieve the desired contact surface.

Figure 12:
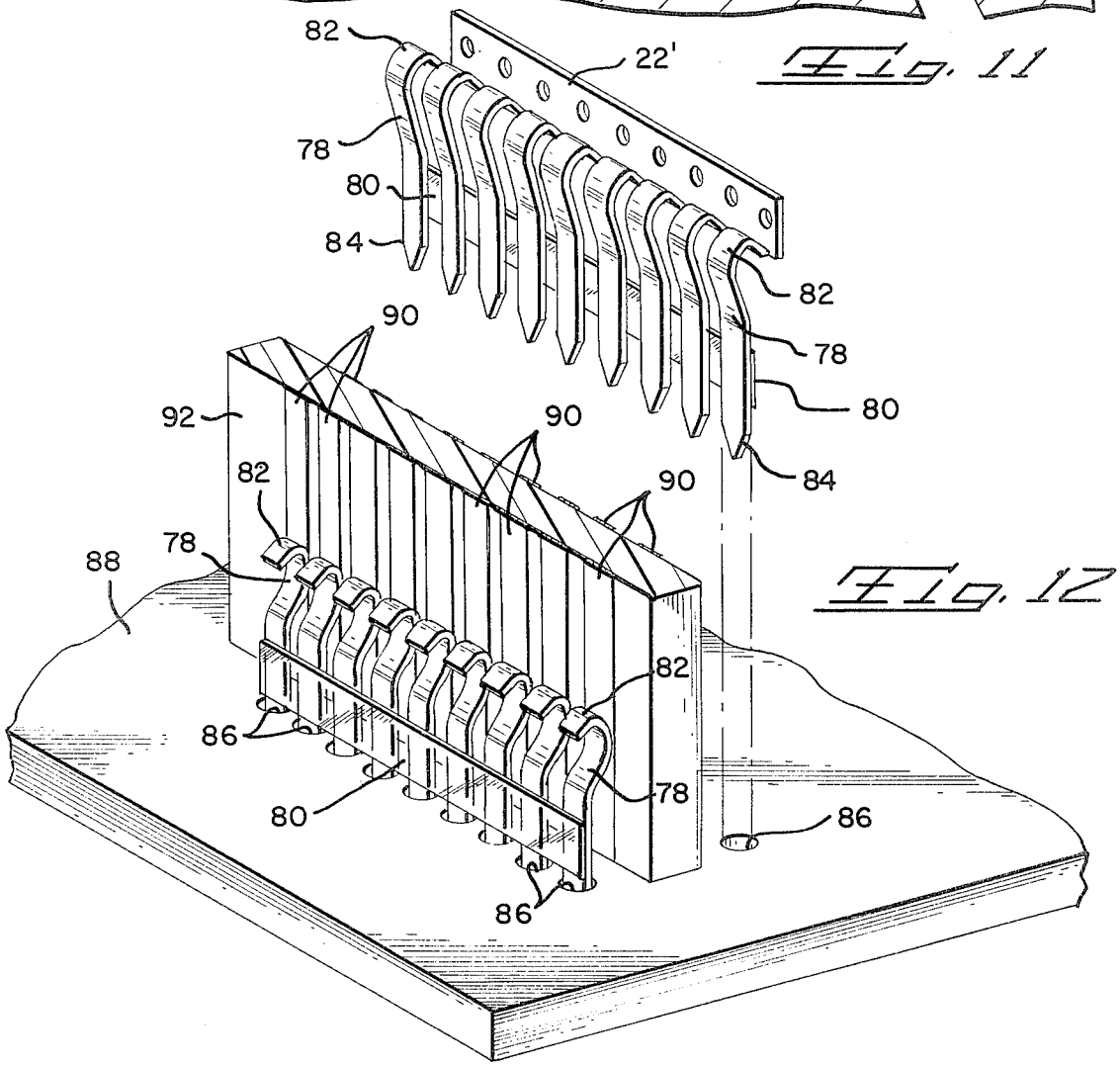
FIG. 12 is a partially exploded, fragmentary perspective of another embodiment of the present invention in a mother board-daughter board assembly.

FIG. 12 is illustrative of another embodiment of the present invention wherein a plurality of a curvilinear contacts 78 are bonded to and spaced along a continuous web of insulative material 80. As shown the ends 82 and 84 of the contacts 78 project outwardly from the side margins of the insulative material 80 to provide electrical terminal portions. For example, the projecting ends 84 may be inserted within a row of corresponding apertures 86 provided in a printed circuit board 88 leaving a row of contacts 78 maintained in spaced relationship by the laminate 80. The ends 84 of the terminals may then be soldered in place to permanently affix the contacts 78 in mounted position on the printed circuit board. The ends 82 of the contacts 78 may engage against corresponding electrical pads 90 provided on another printed circuit board 92 which is, for example inserted between two rows of contacts 78. Insertion of the printed circuit board 92 will resiliently deflect the contacts 78. The inherent resiliency of the contacts 78 will apply spring pressure to the ends 82 of the contacts to establish good electrical connections with the circuit pads 90. In this case it may be desirable to maintain a common carrier strip 22', which is similar to the carrier strip 22 attached to the contacts 78, even after formation of the contacts to their curvilinear configurations in a roll forming stage similar to the one illustrated at 30 in FIG. 3. In this manner an entire row of contacts 78 may be located within respective apertures 86 of the printed circuit board 88, using the carrier strip 22' and also the insulative material 80 to align the contacts prior to and during soldering of the contacts 78 to the printed circuit board. Subsequently, the carrier strip 22' may be removed such as by breaking or otherwise severing it from the row of contacts 78.

In each embodiment illustrated the sheet material 28 provides flexible webs of insulation separating and maintaining the contacts in desired spaced relationship. The web portions are severable as desired to select any desired number of contacts for an intended use.

Figure 13:
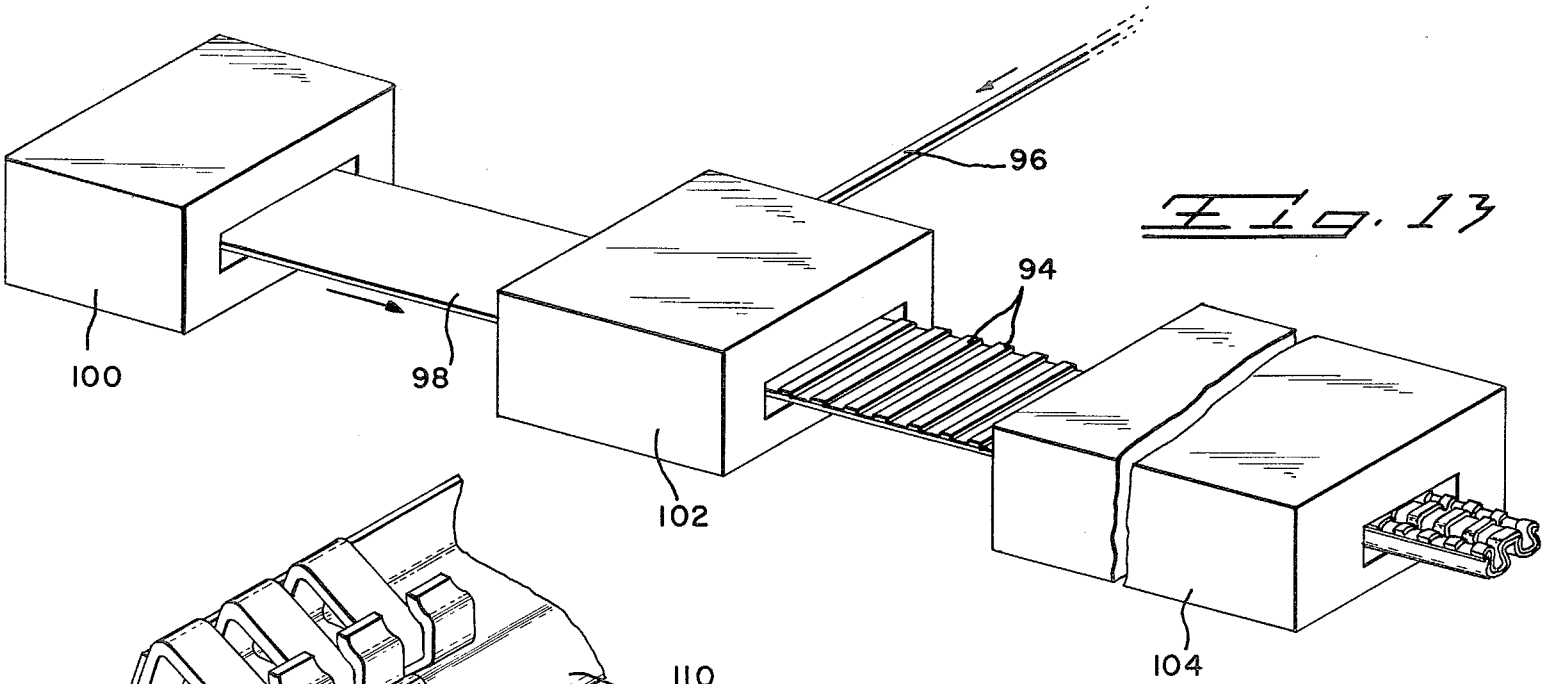
FIG. 13 is a schematic of an alternate apparatus for fabricating a laminated connector according to the present invention.

The apparatus schematically shown in FIG. 13 severs individual contacts 94 from a continuous band or reel of metal contact material 96 and deposits the separate contacts transversely across a moving web 98 of insulation material, such as Mylar or paper as described above. The web 98 is fed from a supply 100 to the bonding station 102. The contacts are deposited in parallel spaced configuration on web 98 and are bonded thereto. In order to accomplish the bonding, the web can be pretreated with a suitable adhesive. Bonding can be accomplished by pressure, heat or a combination thereof. The strip of insulating web with contacts bonded thereto is sent through a forming station 104 in the manner previously described with references to FIGS. 5 to 10.

Figure 14:
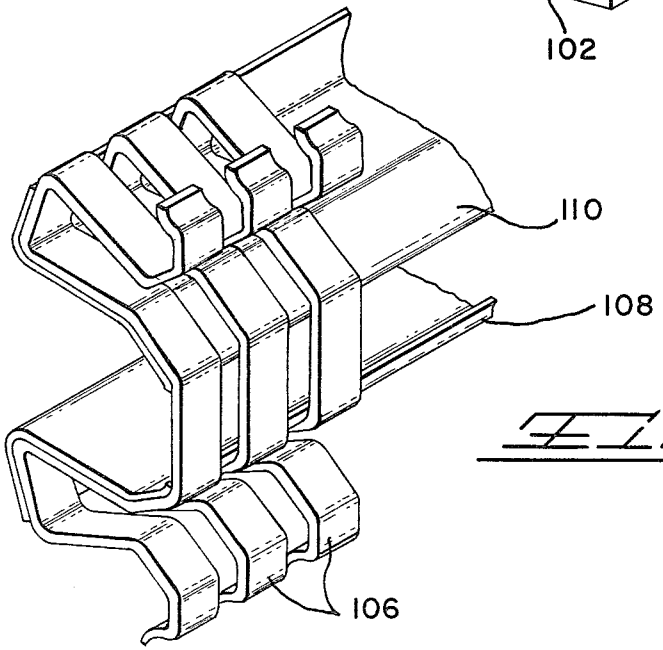
FIG. 14 is a fragmentary enlarged perspective of an alternate embodiment of a laminated connector according to the present invention.

FIG. 14 shows another alternative embodiment of the subject connector strip. In this embodiment each contact 106 is bonded to a pair of parallel spaced insulation webs 108, 110. This is simply to illustrate that one or more webs can be used for each strip of contacts regardless of which of the above-described methods are used to form the strip.

Figures 15, 16, 17, 18:
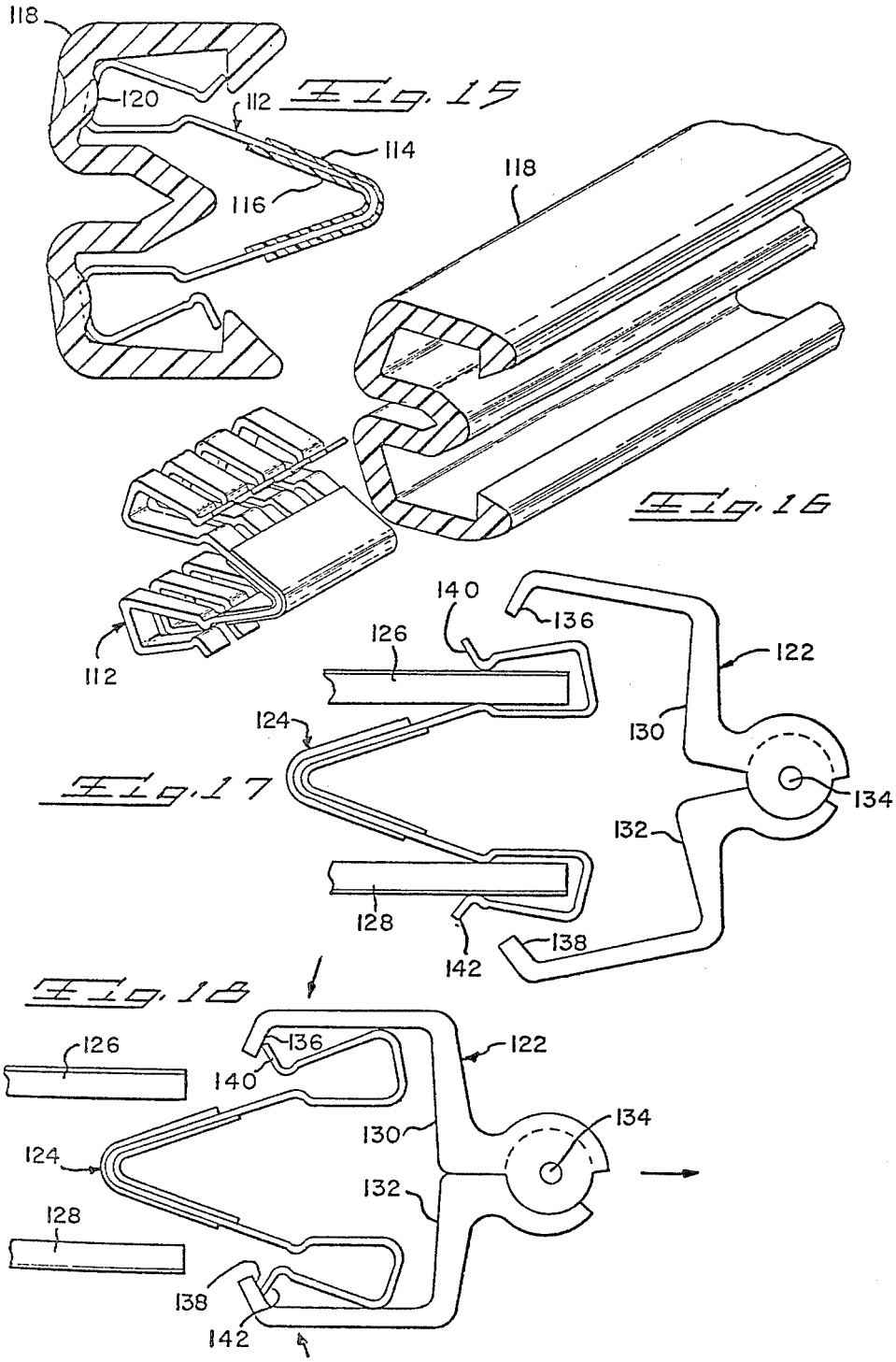
FIG. 15 is a transverse section through another embodiment of the subject laminated connector mounted in a housing.
FIG. 16 is an exploded perspective view of the laminated connector and housing of FIG. 15.
FIGS. 17 and 18 are side elevations showing the operation of a tool used to remove the subject laminated connector from connection with a pair of parallel spaced printed circuit boards.

There may be instances when it is desirable to have the subject laminated connector enclosed within a housing. Such an embodiment is shown in FIGS. 15 and 16. In this embodiment the connector 112 has been formed with insulation webs 114 and 116 on opposite sides thereof and the connector as a whole is inserted into a channel-shaped housing 118. Portions of the housing are deformed inwardly, to form a locking bump 120 between adjacent contacts or at the end of a strip of contacts thereby preventing the unintentional removal of the laminated connector from the housing.

FIGS. 17 and 18 show the operation of a tool 122 used for removing laminator connector 124 from the edge of a pair of spaced printed circuit boards 126, 128. The tool 122 simply comprises elongated members 130, 132 pivotally hinged together on a pivot pin 134. The members 130, 132 define elongated arms having hooked free ends 136, 138, respectively arranged to grip over the free ends 140, 142 of the laminated connector 124 to remove simultaneously all contacts of the connector from the printed circuit boards 126, 128 without crushing the contacts or otherwise damaging the connector. It will be noted from FIG. 18 in particular, that in the closed condition the tool has a spacing between the arms which is substantially equal to the widest dimension of the laminated connector.

Figure 19:
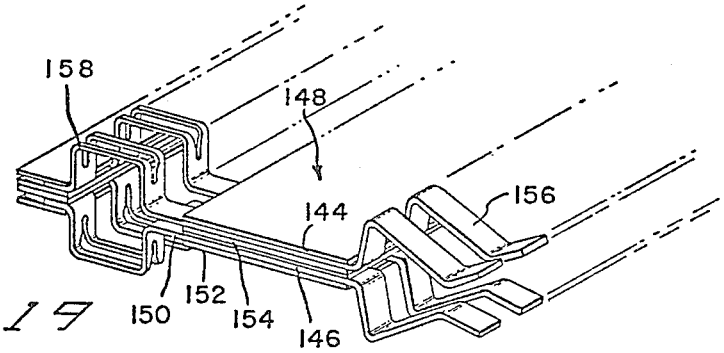
FIG. 19 is a further alternate embodiment of the subject laminated connector including an insulation displacing slotted beam configuration on one end thereof.

FIG. 19 shows a further embodiment in which two identical strips of formed laminated connectors 144, 146 are joined together in an opposing configuration to form a connector assembly 148. Each of the strips of laminated connectors 144, 146 includes a plurality of contacts 150 bonded between layers of insulation 152, 154. One end of each contact 150 is formed into a printed circuit board engaging portion 156 and the opposite end into an insulation displacing slotted beam configuration 158. The strips of contacts 144, 146 can be held together in this configuration by an external means (not shown), such as a clamp or housing, or by bonding together the adjacent layers of insulation. The strips 144, 146 could also be formed by folding a single strip upon itself. The opposing portions 156 of the pairs of contacts 150 define therebetween a substantially C-shaped printed circuit board receiving portion.

Figure 20:
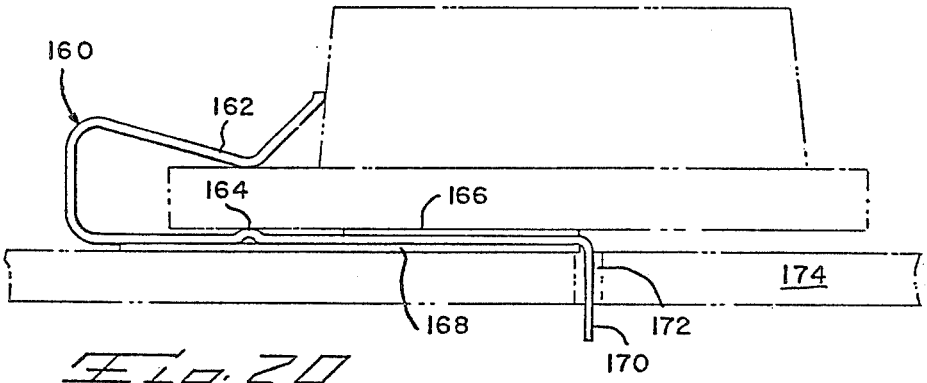
FIG. 20 is a side elevation of a yet another alternate embodiment of the subject laminated connector for making a mother-daughter board connection between parallel printed circuit boards.
Figure 21:
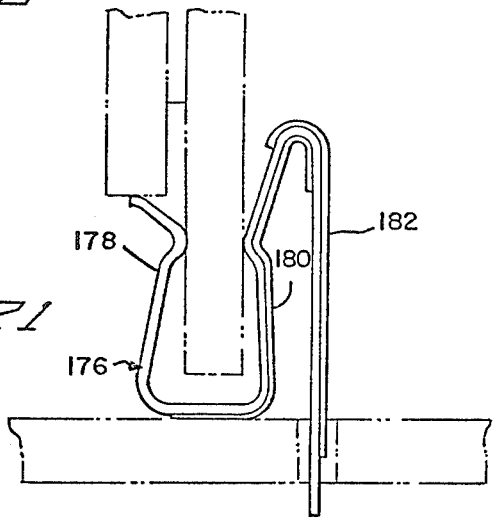
FIG. 21 is a further alternate embodiment of the subject laminated connector for connecting mother-daughter boards in a perpendicular configuration.

FIGS. 20 and 21 show two further embodiments for effecting a mother-daughter board interconnected by the subject laminated connector. In the first of these embodiments, the connector 160 has a C-shaped board engaging portion 162, an opposing bump 164, layers of insulation 166, and 168, and solder tab 170 extending through a hole 172 in the board 174. In the embodiment shown in FIG. 21, the connector 176 includes a C-shaped board engaging portion 178, layers of insulation 180 and 182 which extends parallel to the opening direction of the board engaging portion 178.

Figure 22:
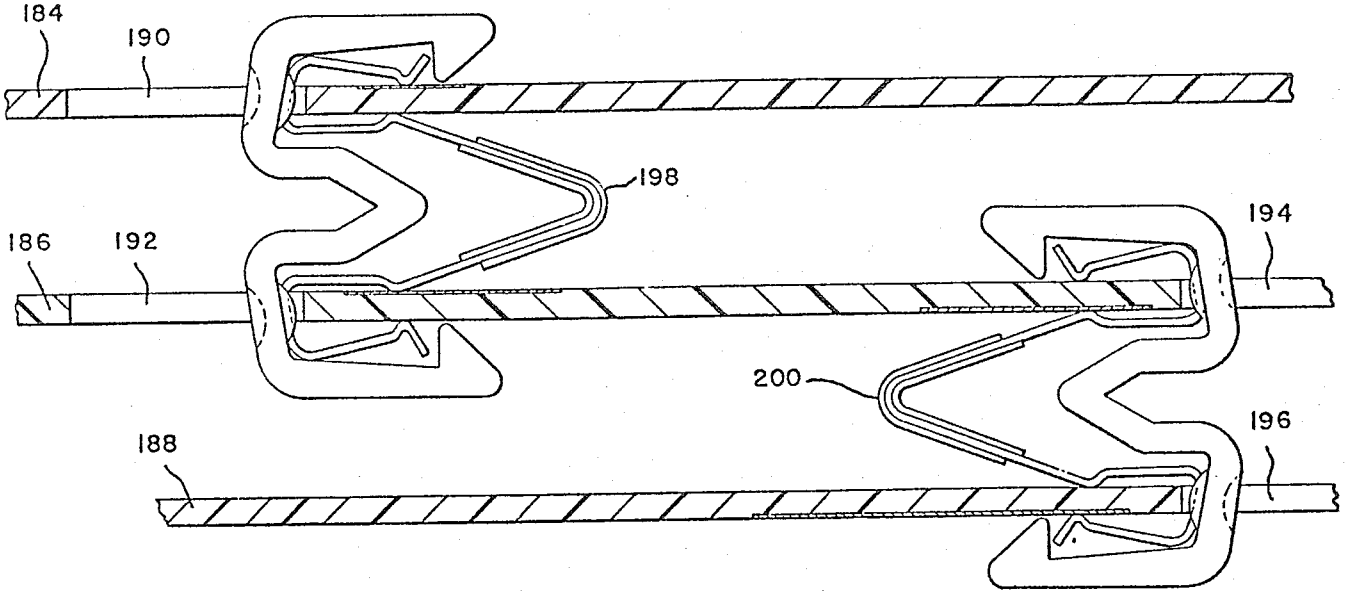
FIG. 22 is a vertical section through several parallel, spaced printed circuit boards with the subject laminated connector making interconnection via enlarged apertures spaced from the edges of the respective boards.

FIG. 22 shows the subject laminated connector as it could be used to effect interconnection in the middle of parallel, spaced printed circuit boards. The boards 184, 186, and 188 are provided with apertures 190, 192, 194, and 196 which are spaced from their respective peripherial edges. The boards are held in a fixed, parallel, spaced relation by the engagement of the connector assembly 198 through apertures 190 and 192 and the connector assembly 200 through apertures 194 and 196.

Figure 23:
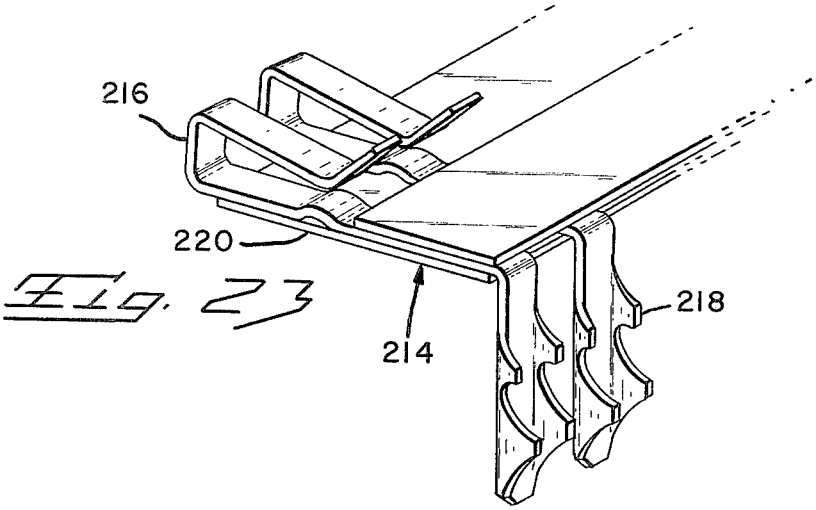
FIG. 23 is a further alternate embodiment of the subject laminated connector with a crimp barrel on one end thereof.

A further alternate embodiment of the subject laminated connector 214 is shown in FIG. 23. This embodiment 214 has a C-shaped board engaging portion 216 on one end and a wire barrel 218 on the other end. The wire barrel includes at least one pair of crimp ears to crimp connect the contacts to respective conductors (not shown). This embodiment also includes at least one web of insulation 220.

Figure 24:
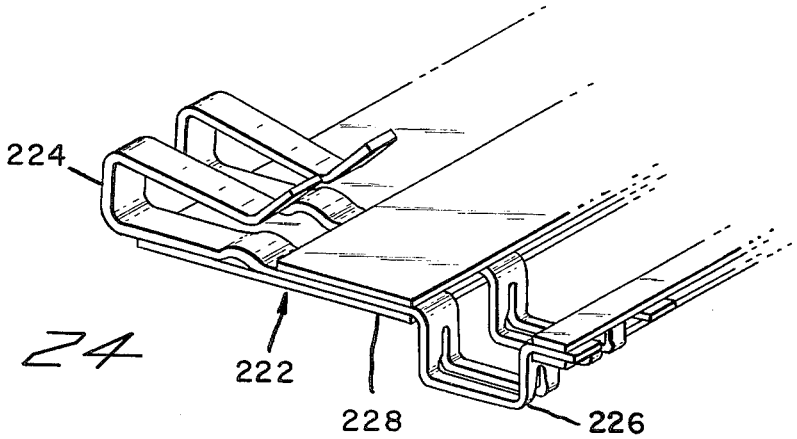
FIG. 24 is a further alternate embodiment of the subject laminated connector with an insulation displacing slotted beam configuration on one end thereof.

The final illustrative embodiment is shown in FIG. 24. This connector 222 has a C-shaped board engaging portion 224 on one end and a slotted beam profile 226 defining an insulation displacing slot on the opposite end. The connector also includes at least one web of insulation 228 and would receive conductors (not shown) in the slotted beam profile 226 in the known manner.

What has been described and illustrated are exemplary laminated connector configurations, as well as apparatus and the method for making the same. Likewise, reference to use of the subject connector to interconnect printed circuit boards is simply an example and not an exclusionary use. It should be understood that other modifications and embodiments of the present invention will become apparent to one having ordinary skill in the art from the spirit and scope of the appended claims.

What is claimed is:

1. A laminated connector, comprising:

a plurality of identical elongated metal contacts;

at least one continuous web of insulative sheet material of a width less than the length of said contacts, the entire width of said web being bonded to at least one portion of each of said metal contacts an end portion of which projects outwardly from at least one side edge of said web of insulative sheet material, said web being sufficiently rigid to prevent relative flexure between adjacent contacts while allowing individual outward flexing of the free ends of the contacts;

said contacts bonded to said web of insulative material being permanently bent to generally curvilinear shapes to define at least one substantially U-shaped end portion adapted to receive therein a mating member, with like end portions of adjacent ones of said contacts being substantially in alignment to form a row of terminals;

said metal contacts being sufficiently thick to serve as resilient leaf springs for applying contact pressure at such end portions; and said web of insulative sheet material separating said contacts from one another with fixed spacing.

2. The connector according to claim 1, wherein said web of insulation material provides a continuous jacket of insulation covering only intermediate portions of said contacts and serving as a housing therefor.

3. The connector according to claim 2, wherein the web of insulation material is severable transversely at any point intermediate adjacent contacts to separate any desired number of contacts from the remainder thereof.

4. The connector according to claim 1, wherein the opposite end portion of each said contact is profiled to be pluggably received in an aperture in a printed circuit board.

5. The connector according to claim 4 wherein said profiled opposite end portion of each said contact is soldered into said printed circuit board.

6. The connector according to claim 1, wherein at least one end portion of each said contact projects laterally outwardly from at least one side of said web to provide a cantilever leaf spring element.

7. The connector according to claim 1, wherein said contact end portions are reversely curved into U-shapes symmetrical with respect to the longitudinal axis of the connector each providing a receptacle for pinched electrical and mechanical engagement with opposite sides of mating contact members inserted therein.

8. A multiple contact connector, comprising:

a plurality of identical, elongated, resilient spring metal electrical contacts, at least one continuous web of flexible insulative sheet material having a width less than the length of said contacts, said contacts bonded transversely across the entire width of said at least one web of insulative material in fixed, parallel, spaced apart relation, with end portions of adjacent ones of said contacts projecting beyond at least one marginal edge of said web and being substantially in alignment to form a row of terminals, said metal contacts being sufficiently thick to serve as resilient leaf springs for applying contact pressure at such end portions, and said metal contacts and web of insulative material bonded thereto being permanently bent to generally curvilinear shapes to define at least one substantially U-shaped end adapted to pinchingly engage and make electrical and mechanical engagement with opposite sides of a mating contact member received therein.

9. A laminated connector, comprising:

a plurality of identical elongated metal contacts;

at least one continuous web of flexible insulative sheet material of a width less than the length of said contacts and bonded across the entire width of the web to at least one portion of each of said metal contacts to hold said contacts in fixed, parallel, spaced apart relation with the ends thereof projecting from at least one marginal edge of the web in substantial alignment to form a row of terminals;

said contacts having a first side bonded to said web of insulative material and being permanently bent to generally curvilinear shapes to define at least one end portion of substantially U-shape adapted to receive a mating member therein to be grippingly engaged on opposite sides thereof to effect both electrical and mechanical engagement by said contacts;

said metal contacts being sufficiently thick to be free standing and self supporting to serve as resilient leaf springs for applying contact pressure at such end portions.

10. A laminated connector according to claim 5 further comprising a continuous strip of metal having a side margin to which at least one end of each of said contacts are initially frangibly attached and said strip of metal being removable from said contacts leaving them independent of one another.

11. A laminated connector according to claim 9 further comprising:

a second continuous web of flexible insulative sheet material of a width substantially equal to that of said at least one continuous web and bonded across its entire width to at least one portion of each of said metal contacts on the side opposite to said at least one continuous web of flexible insulative sheet material.

12. A laminated connector according to claim 9 further comprising:

a second continuous web of flexible insulative sheet material of less width than the length of said contacts bonded over the entire width to at least one portion of each first side of said metal contacts parallel to and spaced from said at least one continuous web of flexible insulative sheet material.

13. A laminated connector according to claim 9 further comprising:

a second preformed continuous web of rigid insulative sheet material adapted to receive therein a strip of formed contacts bonded to said web of insulative sheet material to form a housing substantially enclosing said contacts.

14. A multiple contact connector, comprising:

a plurality of identical, elongated, resilient electrical contacts formed of spring metal of sufficient thickness to make the contacts both free standing and self supporting to serve as resilient leaf springs for applying contact pressure at end portions thereof;

at least one continuous web of flexible insulative sheet material having a width less than the length of said contacts, said contacts having a first side bonded transversely across the entire width of said web of insulative material in parallel relation with fixed spacing therebetween and with end portions of adjacent ones of said contacts projecting from a marginal side edge of said web and being substantially in alignment to form a row of terminals;

said metal contacts and bonded web of insulative material being permanently bent to generally curvilinear shapes defining at least one end thereof a substantially U-shaped portion adapted to receive mating contact members therein in such manner as to pinch said member from opposite sides thereof making both mechanical and electrical engagement therewith.

15. A multiple contact connector according to claim 14 further comprising:

a second continuous web of flexible insulative sheet material bonded to said contacts spaced from said at least one continuous web of flexible insulative sheet material.

16. A multiple contact connector according to claim 14 further comprising:

a second continuous web of flexible insulative sheet material bonded to said contacts on the side opposite said at least one continuous web of flexible insulative sheet material.

17. A multiple contact connector according to claim 14 wherein:

both end portions of each said contacts are bent to generally curvilinear shapes defining U-shaped mating contact receiving members opening in the same direction and substantially symmetrical with the longitudinal axis of said connector.

18. A multiple contact connector according to claim 14 further comprising:

a substantially channel shaped, continuous member of rigid insulation material adapted to receive therein a strip of said contacts bonded to said web and form a housing therefor.

19. A multiple contact connector according to claim 14 wherein:

the other end portion of each said contact is profiled to be received in and soldered to an aperture in a printed circuit board.

20. A multiple contact connector according to claim 14 wherein:

the other end portion of each said contact further comprises at least one pair of crimp ears whereby a conductor is attached to said contact by crimping said crimp ears.

21. A multiple contact connector according to claim 14 wherein:

the other end portion of each said contact further comprises a slotted beam profile defining an insulation displacing slot for making engagement with conductors.

22. A multiple contact connector assembly comprising:

first and second juxtapositioned strips of multiple contacts, each said strip comprising a plurality of identical, elongated, linear, resilient electrical contacts formed of spring metal of sufficient thickness to be both free standing and self supporting, at least one continuous web of flexible insulated sheet material, said contacts bonded transversely across said web of insulative material in parallel relation with fixed spacing therebetween and with end portions of adjacent ones of said contacts being substantially in alignment to form a row of terminals, said metal contacts and bonded web of insulation material being permanently bent to generally curvilinear shapes at least one like end portion of the contacts of each said strip in combination defining a substantially U-shaped portion adapted to receive therein a mating contact member in such manner that the contacts pinch said member from opposite sides thereof.

23. A multiple contact connector assembly according to claim 22 wherein each said electrical contact further comprises an insulation piercing slotted beam configuration on the opposite end portion thereof.

24. A multiple contact connector assembly according to claim 22 wherein said other end of each of said contacts is adapted to be received in an aperture of a printed circuit board with said strips in parallel spaced relation.

25. A multiple contact connector assembly according to claim 22 wherein said strips are bonded together.

* * * * *